US005324227A

United States Patent [19]

Yuh-Ching

[11] Patent Number: 5,324,227

[45] Date of Patent: Jun. 28, 1994

[54] TOY HITTING ROD

[76] Inventor: Chang Yuh-Ching, P.O. Box 82-144, Taipei, Taiwan

[21] Appl. No.: 75,228

[22] Filed: Jun. 10, 1993

[51] Int. Cl.[5] ..... A63H 33/30; A63H 33/00; A63B 69/02; A63B 69/34

[52] U.S. Cl. ..... 446/473; 446/486; 482/12; 482/83

[58] Field of Search ..... 446/473, 1, 4, 486, 446/487, 490, 491, 144; 273/84 R; 482/12, 83, 106, 109

[56] References Cited

U.S. PATENT DOCUMENTS

| | | | |
|---|---|---|---|
| 2,495,967 | 1/1950 | Hamilton | 446/487 |
| 3,037,320 | 6/1962 | Powell | 446/473 |
| 3,454,274 | 7/1969 | Kaneshiro | 446/473 X |
| 3,921,976 | 11/1975 | Lane | 273/84 R X |
| 4,594,072 | 6/1986 | Cowell | 446/486 X |
| 4,819,137 | 4/1989 | Hamilton | 482/109 X |
| 4,892,303 | 1/1990 | Lohre | 446/473 X |
| 5,120,261 | 6/1992 | Dietzman | 446/486 X |
| 5,127,871 | 7/1992 | Miller | 446/473 |
| 5,174,756 | 12/1992 | Taylor | 446/473 X |
| 5,219,163 | 6/1993 | Watson | 446/473 X |
| 5,256,099 | 10/1993 | Rudell et al. | 446/473 |

FOREIGN PATENT DOCUMENTS

| | | | |
|---|---|---|---|
| 3341810 | 5/1985 | Fed. Rep. of Germany | 482/12 |
| 1101525 | 10/1955 | France | 446/473 |
| 1480833 | 5/1989 | U.S.S.R. | 482/12 |
| 1447703 | 8/1976 | United Kingdom | 482/12 |
| 2125302 | 3/1984 | United Kingdom | 482/83 |

*Primary Examiner*—David N. Muir
*Attorney, Agent, or Firm*—Alfred & Jason

[57] ABSTRACT

This invention relates to a toy hitting rod and in particular to one which includes a main hitting rod made of resilient material and formed with a longitudinal hole at the center and two aligned holes at one end thereof, an inner hitting rod made of resilient material and inserted into the longitudinal hole of the main hitting rod, a spring sleeved on one end of the inner hitting rod, a hand grip made of hard material and having a recess for taking a firm hold thereto, the grip having a connecting rod having a through hole in alignment with the aligned holes of the main hitting rod, the connecting rod being provided with two protuberances engageable with the other end of the spring, the hand grip further having a flange at its intermediate portion, a guard plate made of resilient material and having a hole at the center, a casing put over the main hitting rod and having two aligned holes in alignment with the two aligned holes of the main hitting rod, and a limiting collar composed of two semi-cylindrical members and having a neck portion on which is force-fitted the guard plate, whereby the toy hitting rod may be of high resiliency, long service life, and appealing appearance.

2 Claims, 8 Drawing Sheets

TOY HITTING ROD

BACKGROUND OF THE INVENTION

Heretofore, it has been found that various kinds of toy hitting rod have been sold in the marketplace, but none of them are satisfactory in use.

As shown in FIGS. 4, 5 and 8A, the prior art toy hitting rod is composed of a soft rod 9, a connecting member 91, a guard plate 9, and a hand grip 95. One end of the soft rod 9 is inserted into a recess 92 of the connecting member 91, and the tail rod 93 of the connecting member 91 is inserted into the longitudinal hole 96 of the hand grip 95 through the center hole 94 of the guard plate 90.

FIGS. 6, 7 and 8B show another prior art toy hitting rod. As illustrated, the prior art toy hitting rod is composed of a rod 8 made of soft material and having a recess 81, a hand grip 82 having a flange 85 and a connecting rod 83, and a guard plate 80.

However, such toy hitting rods are easily permanently deformed, damaged or broken. Besides, the rods are made of foamed plastics and so they are ugly in appearance and cannot be printed with any characters or signs.

Therefore, it is an object of the present invention to provide a toy hitting rod which may obviate and mitigate the above-mentioned drawbacks.

SUMMARY OF THE INVENTION

This invention relates to an improved toy hitting rod.

It is the primary object of the present invention to provide a toy hitting rod which is safe in use.

It is another object of the present invention to provide a toy hitting rod which is of high resiliency.

It is still another object of the present invention to provide a toy hitting rod which is of a long service life.

It is still another object of the present invention to provide a toy hitting rod which will not be permanently deformed even after it has been used for a considerably period of time.

It is a further object of the present invention to provide a toy hitting rod which is appealing in appearance.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
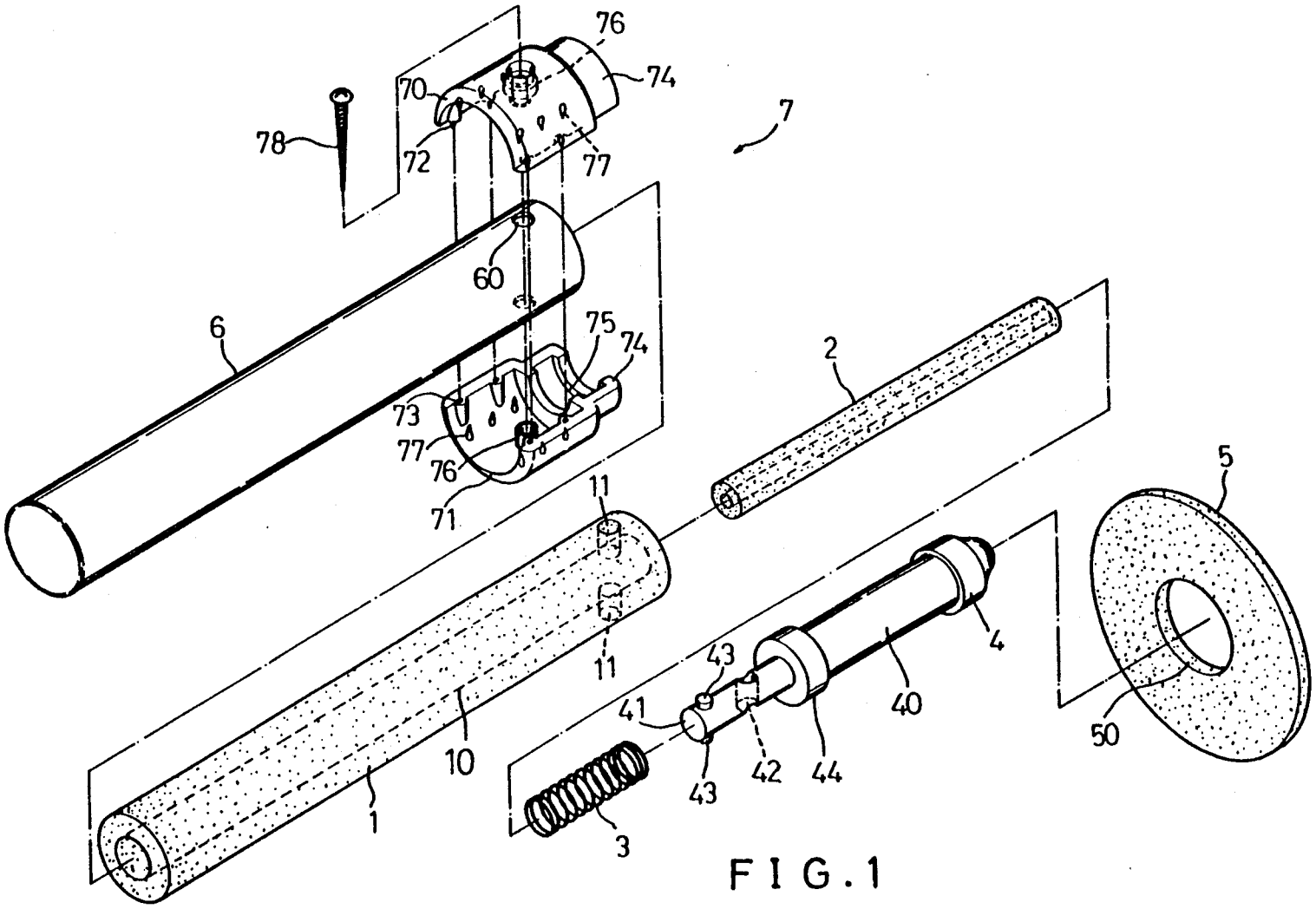
FIG. 1 is an exploded view of the present invention.
Figure 2:
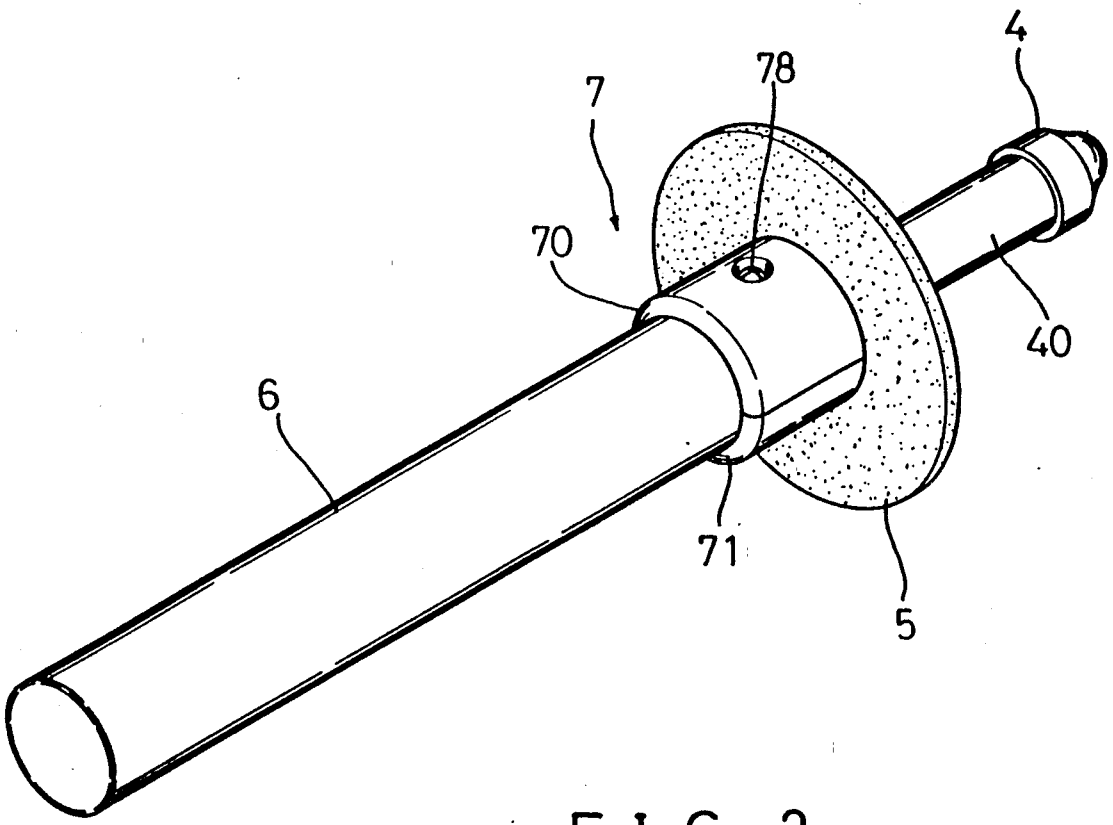
FIG. 2 is a perspective view of the present invention.
Figure 3B:
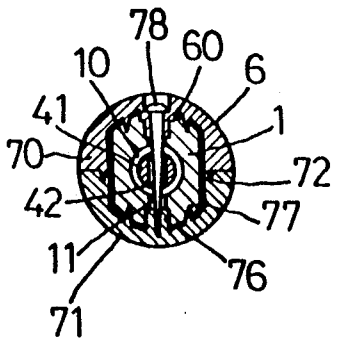
FIG. 3B is a cross sectional view of the present invention.
Figure 3A:
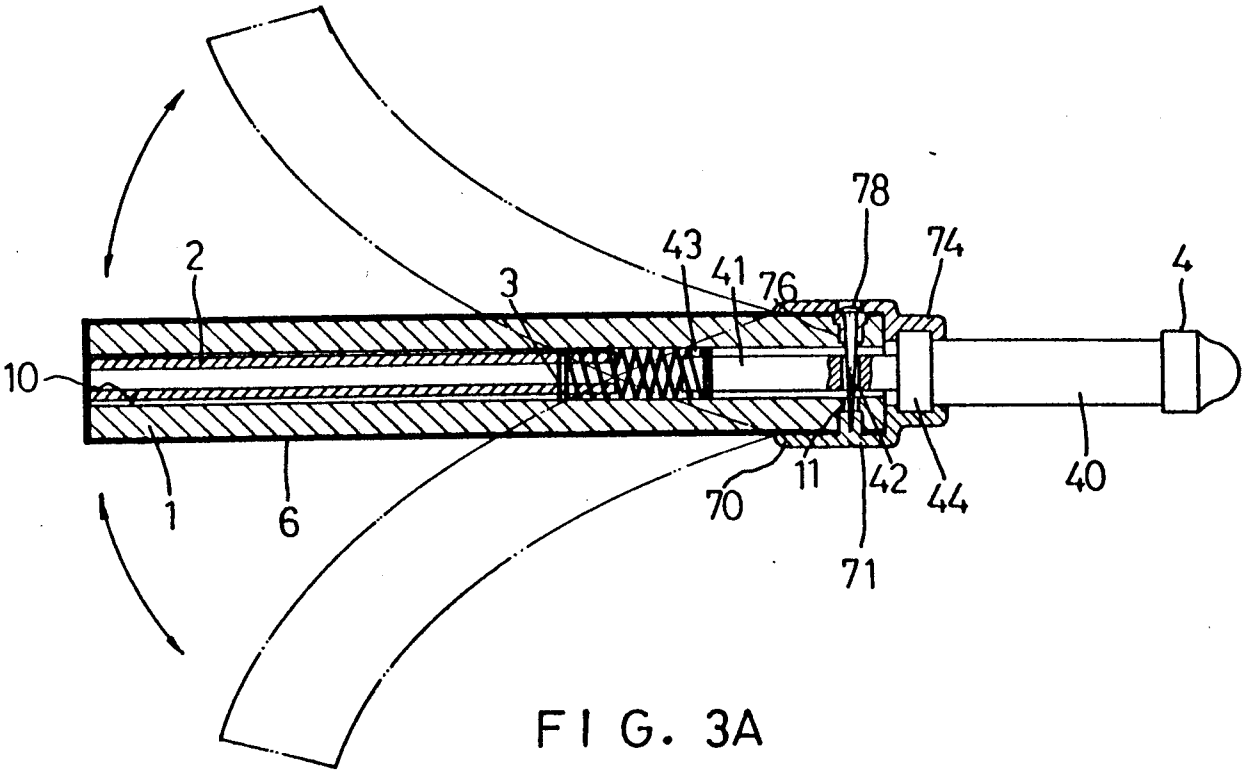
FIG. 3A is a longitudinal sectional view of the present invention.
Figure 4:
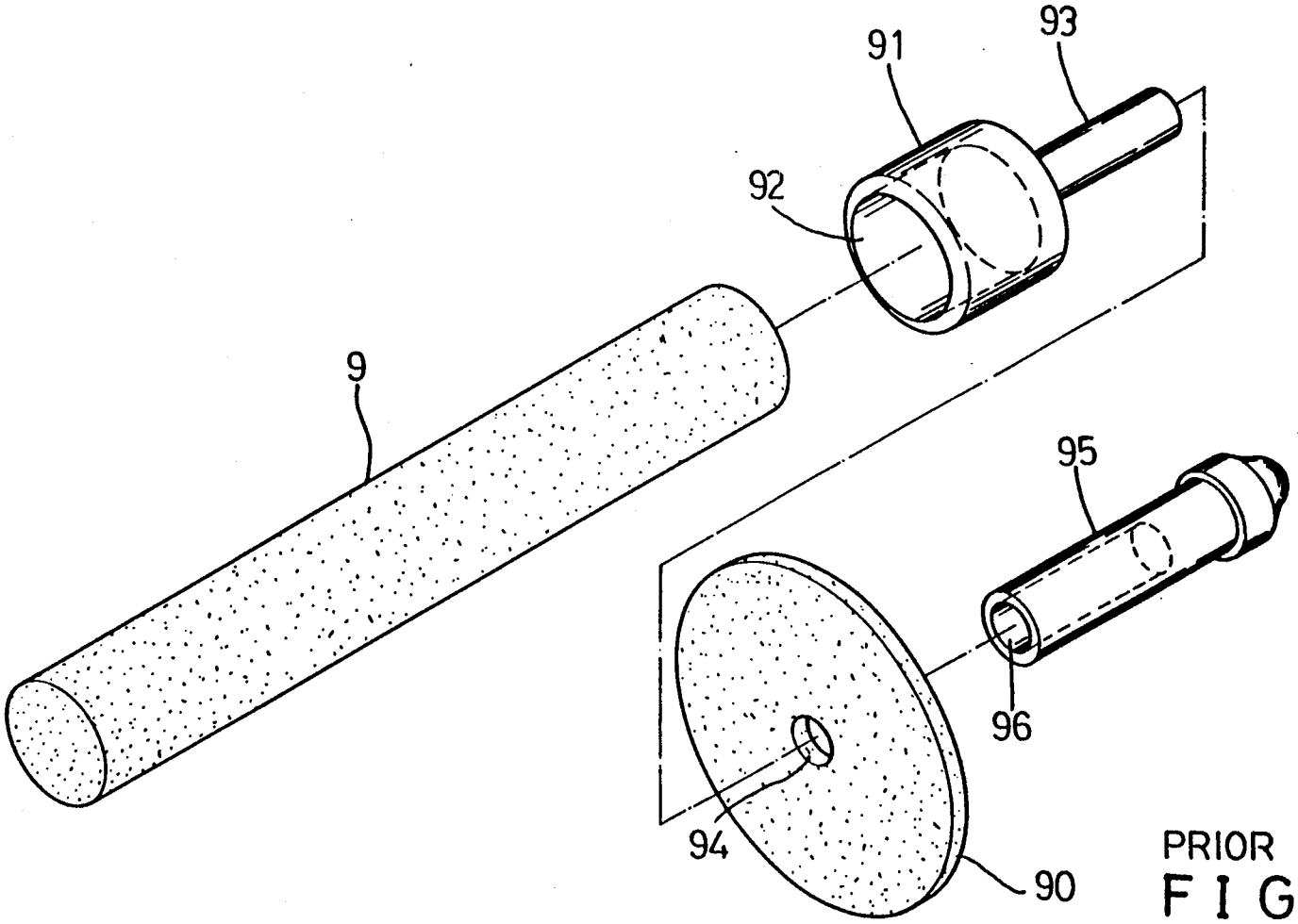
PRIOR ART FIG. 4
FIG. 4 is an exploded view of a first prior art toy hitting rod.
Figure 5:
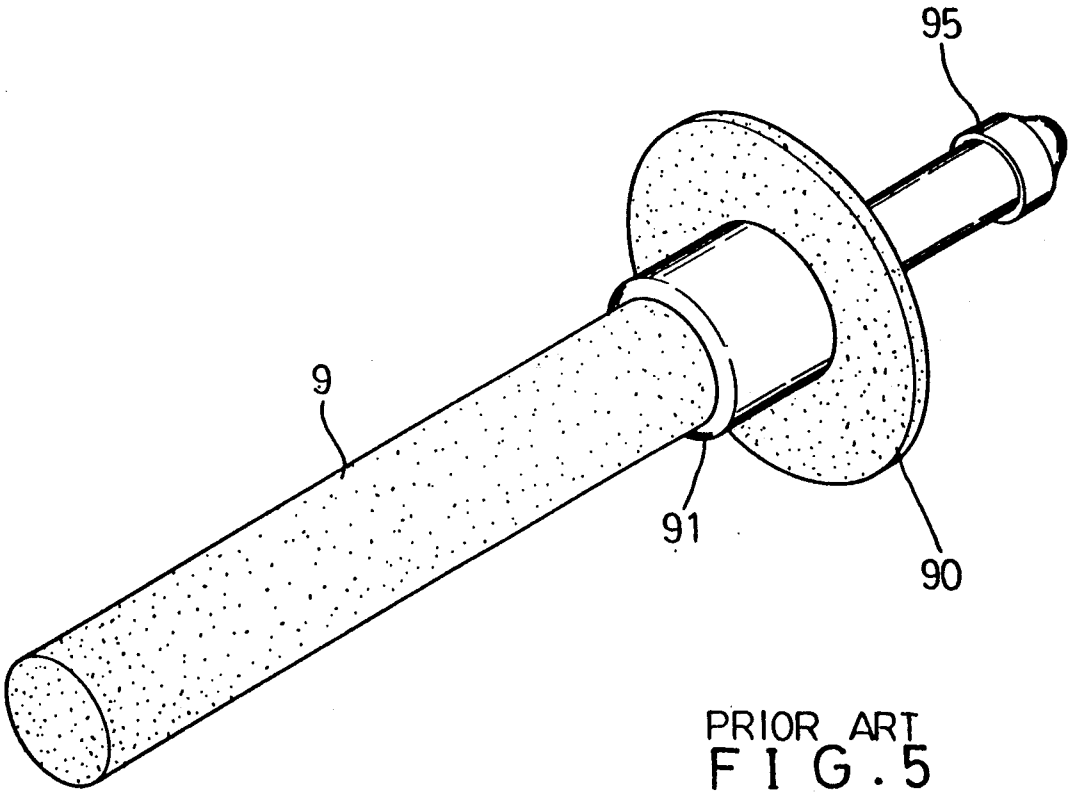
PRIOR ART FIG. 5
FIG. 5 is a perspective view of the first prior art toy hitting rod.
Figure 6:
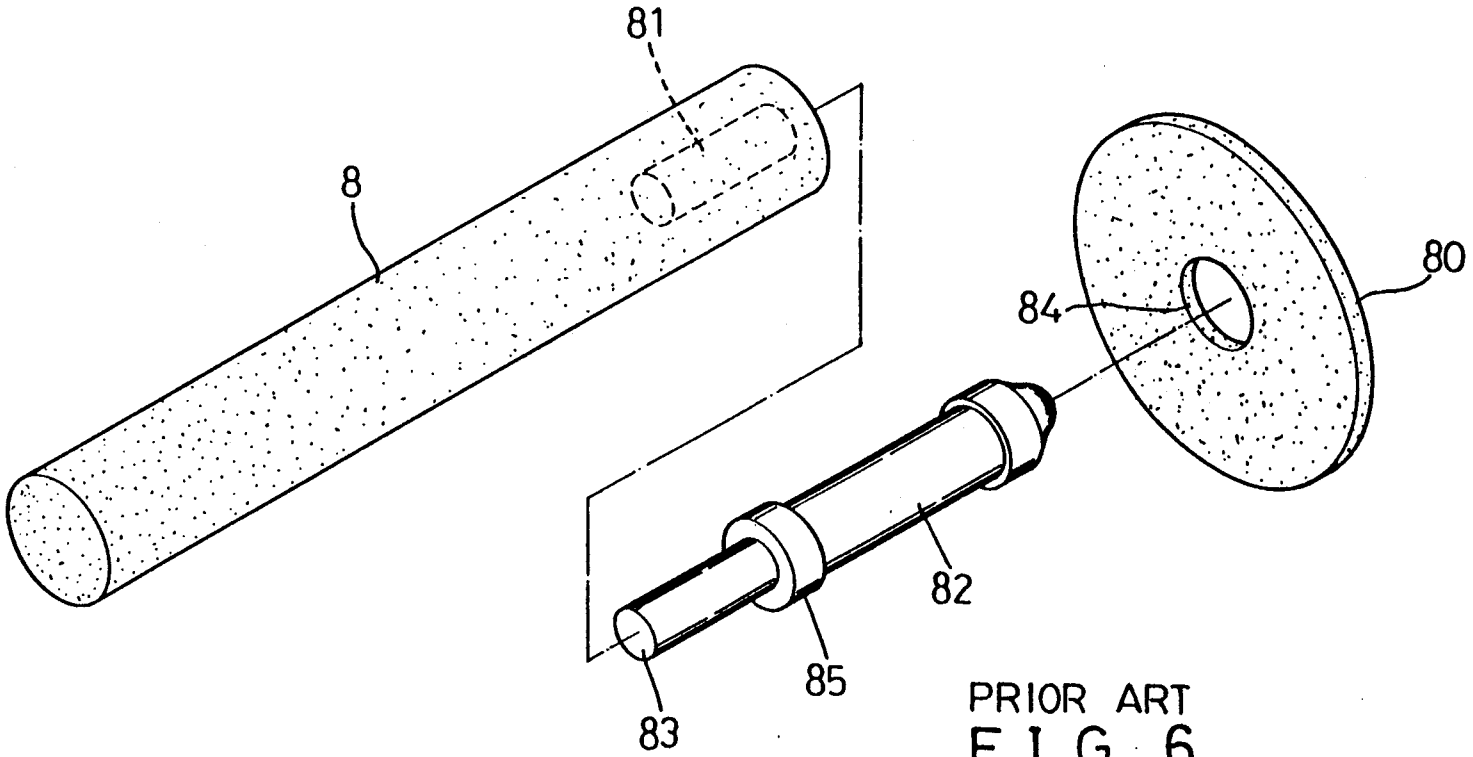
PRIOR ART FIG. 6
FIG. 6 is an exploded view of a second prior art toy hitting rod.
Figure 7:
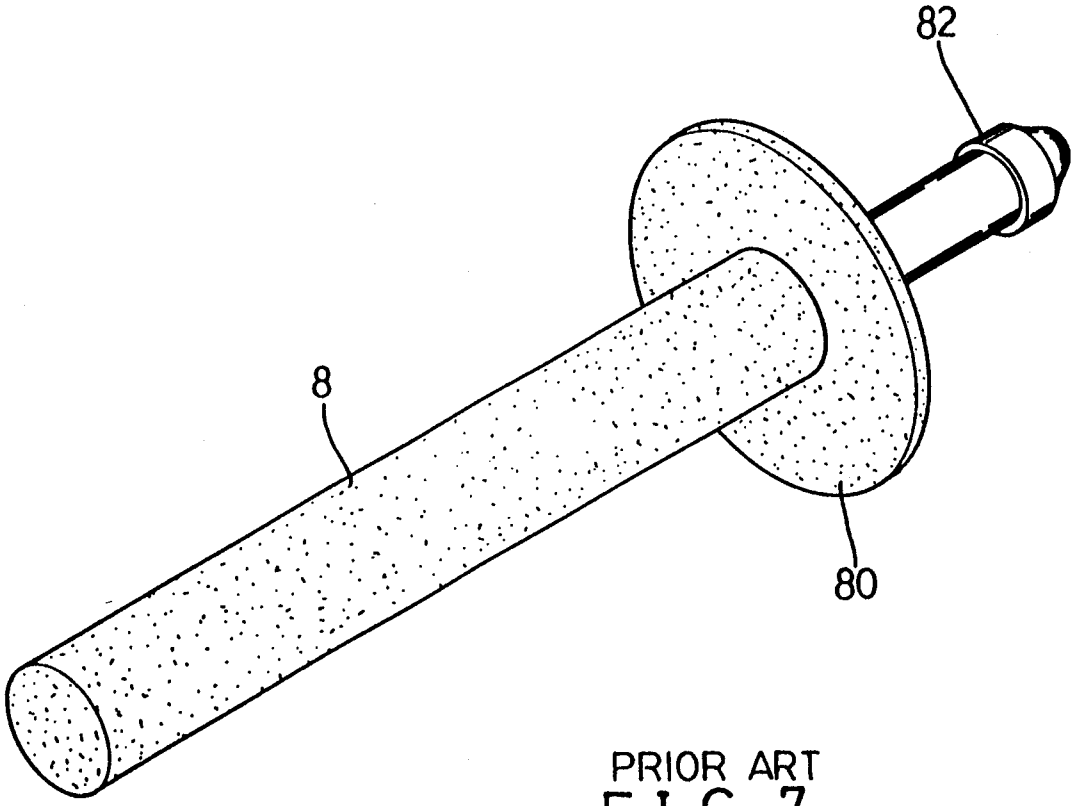
PRIOR ART FIG. 7
FIG. 7 is a perspective view of the second prior art toy hitting rod.
Figure 8B:
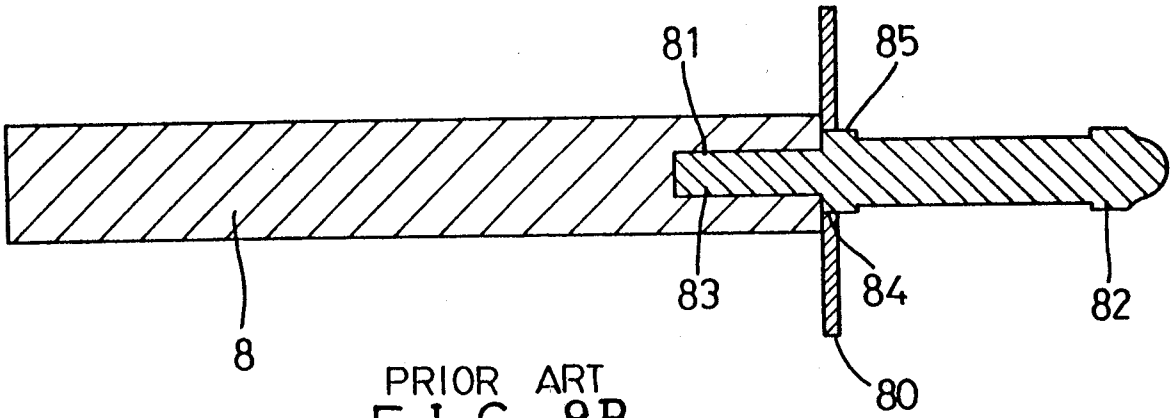
PRIOR ART FIG. 8B
FIG. 8B is a sectional view of a second art toy hitting rod.
Figure 8A:
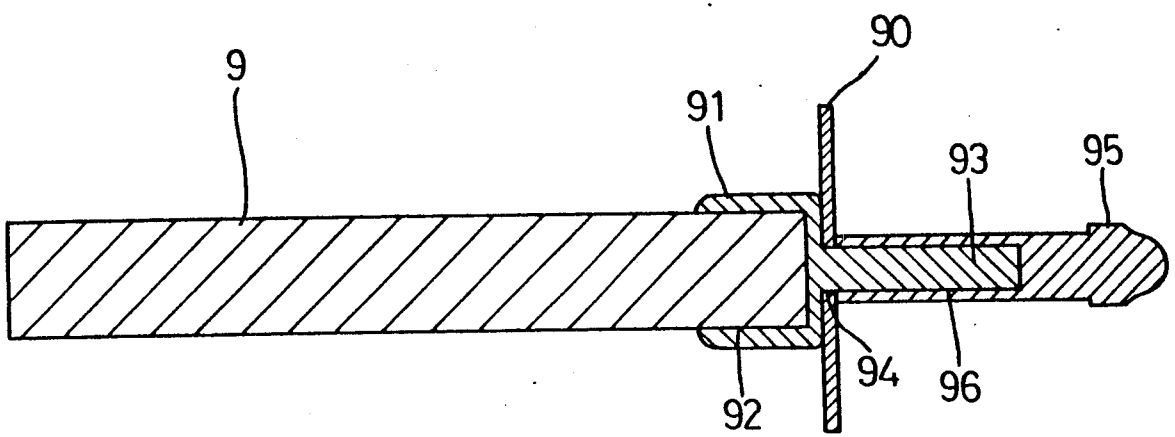
PRIOR ART FIG. 8A
FIG. 8A is a sectional view of the first prior art toy hitting rod.

For the purpose of promoting an understanding of the principles of the invention, reference will now be made to embodiment illustrated in the drawings. Specific language will be used to described same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the toy hitting rod according to the present invention mainly comprises a main hitting rod 1, an inner hitting rod 2, a hand grip 4, a guard plate 5, a casing 6, and a limiting collar 7.

The main hitting rod 1, which is made of resilient material, is formed with a longitudinal hole 10 at the center and two aligned holes 11 at one end thereof.

The inner hitting rod 2 is also made of resilient material and inserted into the longitudinal hole 10 of the main hitting rod 1.

A spring 3 is sleeved on one end of the inner hitting rod 2.

The hand grip 4 is made of hard material and has a recess 40 for taking a firm hold thereof. In addition, the hand grip 4 is formed with a connecting rod 41 having a through hole 42 in alignment with the aligned holes 11 of the main hitting rod 1. Further, the connecting rod 41 is provided with two protuberances 43 which will engage the other end of the spring 3. Furthermore, the hand grip 4 is formed with a flange 44 at its intermediate portion.

The guard plate 5 is made of resilient material and has a hole 50 at the center.

The casing 6 is put over the main hitting rod 1 and has two aligned holes 60 in alignment with the two aligned holes 11 of the main hitting rod 1.

The limiting collar 7 is composed of two semi-cylindrical members 70 and 71 joined together by engaging pins 72 of the semi-cylindrical member 70 with holes 73 of the semi-cylindrical member 71. The semi-cylindrical members 70 and 71 are formed with a neck portion 74 for engaging the hole 50 of the guard plate 5. The semi-cylindrical members 70 and 71 are formed with a recess 75 for receiving the flange 44 of the hand grip 4. In addition, the semi-cylindrical members 70 and 71 are formed each with a tubular member 76 with internal threads and a plurality of sharp-points pins 77.

When in assembly, first mount the spring 3 between the hitting inner rod 2 and the connecting rod 41 of the hand grip 4, and insert them into the longitudinal hole 10 of the main hitting rod 1 so that the through hole 42 of the connecting rod 41 of the hand grip 4 is aligned with the holes 11 of the main hitting rod 1. Then, put the casing 6 on the main hitting rod 1 and align the holes 60 of the casing 6 with the holes 11 of the main hitting rod 1. Thereafter, connected the semi-cylindrical members 70 and 71 with the casing 6 and join the semi-cylindrical members 70 and 71 together by engaging the pins 72 with the holes 73 thereby forming a whole limiting collar 7. In the meantime, the flange 44 of the hand grip 4 is just received in the recess 75 of the limiting collar 7 and the sharp-points pins 77 will pierce into the casing 6. Then, insert a screw 78 through the tubular members 76 of the semi-cylindrical members 70 and 71, the holes 60 of the casing 6, the holes 11 of the main hitting rod 1, and the hole 42 of the hand grip 4. Finally, force-fit the hole 50 of the guard plate 5 with the neck portion 74 of the limiting collar 7.

Although the present invention has been described with a certain degree of particularity, it is understood that the present disclosure is made by way of example only and that numerous changes in the detail of construction and the combination an arrangement of parts may be resorted to without departing from the spirit and scope of the invention as hereinafter claimed.

I claim:

1. A toy hitting rod comprising:

a main hitting rod made of resilient material and formed with a longitudinal hole at the center and two aligned holes at one end thereof;

an inner hitting rod made of resilient material and inserted into the longitudinal hole of said main hitting rod;

a spring sleeved on one end of said inner hitting rod;

a hand grip made of hard material and having a recess for taking a firm hold thereto, said hand grip having a connecting rod having a through hole in alignment with the aligned holes of said main hitting rod, said connecting rod being provided with two protuberances engageable with the other end of said spring, said hand grip further having a flange at its intermediate portion;

a guard plate made of resilient material and having a hole at the center;

a casing put over said main hitting rod and having two aligned holes in alignment with the two aligned holes of said main hitting rod; and a limiting collar composed of two semi-cylindrical members and having a neck portion on which is force-fitted said guard plate.

2. The toy hitting rod as claimed in claim 1, wherein the semi-cylindrical members of said limiting collar are provided with sharp-pointed pins at the inner side.

* * * * *